US009907453B2

(12) United States Patent
Green

(10) Patent No.: US 9,907,453 B2
(45) Date of Patent: Mar. 6, 2018

(54) COMBINATION DISH DRYING MAT AND RACK

(71) Applicant: Umbra LLC, Buffalo, NY (US)

(72) Inventor: David Green, Toronto (CA)

(73) Assignee: Umbra LLC, Buffalo, NY (US)

( * ) Notice: Subject to any disclaimer, the term of this patent is extended or adjusted under 35 U.S.C. 154(b) by 0 days.

(21) Appl. No.: 14/978,506

(22) Filed: Dec. 22, 2015

(65) Prior Publication Data

US 2017/0172378 A1 Jun. 22, 2017

(51) Int. Cl.
*A47L 19/00* (2006.01)

(52) U.S. Cl.
CPC ..... *A47L 19/00* (2013.01)

(58) Field of Classification Search
CPC ..... A47L 19/04; A47L 19/02; A47L 19/00; A47J 47/20; A47J 47/16
USPC ..... 211/41.3, 41.4, 41.5, 41.6; D32/55
See application file for complete search history.

(56) References Cited

U.S. PATENT DOCUMENTS 2,479,118 A 8/1949 Jenness
3,005,209 A * 10/1961 Timmons, Jr. ..... A47J 47/20 4/657
3,800,957 A * 4/1974 Krause ..... A47L 19/04 211/195
3,952,875 A * 4/1976 Lombardo ..... A47J 47/16 211/201
4,527,707 A * 7/1985 Heymann ..... A47L 15/501 211/126.1
4,531,641 A * 7/1985 Archambault ..... A47L 19/02 211/208
4,884,714 A * 12/1989 Bechtel ..... A47J 47/20 206/818
4,947,984 A * 8/1990 Kaufman ..... A45C 11/34 206/1.7
4,958,577 A * 9/1990 Demaio ..... A47B 23/002 108/166
D347,717 S 6/1994 Chapin
D353,921 S 12/1994 Lippisch et al.
D398,725 S 9/1998 Merkel
D418,354 S * 1/2000 O'Rourke ..... D21/662
(Continued)

OTHER PUBLICATIONS https://www.youtube.com/watch?v=emBegADbSSQ, B4Design (an Israeli company at http://www.b4market.co.il/); accessed Apr. 4, 2016 (original 2013).

*Primary Examiner* — Patrick D Hawn
(74) *Attorney, Agent, or Firm* — Simpson & Simpson, PLLC

(57) ABSTRACT

A combination dish drying mat and rack, including a mat and a rack. The mat has a top surface, bottom surface, and a plurality of sides. The rack has a base resting upon at least a portion of the top surface of the mat in an open position. The rack has a plurality of ribs extending upwardly from the base, which form a corresponding plurality of channels, and the plurality of ribs and channels are operatively arranged to hold kitchenware. The rack also has a plurality of protrusions extending upwardly from the base and arranged in pairs. Each protrusion of each pair is disposed opposite one another laterally across the base of the rack. The rack also has a plurality of slots recessed within the base that are co-planar and parallel to one another and the plurality of protrusions and slots are operatively arranged to hold kitchenware.

17 Claims, 9 Drawing Sheets

(56) References Cited

U.S. PATENT DOCUMENTS 6,065,394 A * 5/2000 Gelderman ..... A47J 37/10 99/424
6,125,548 A * 10/2000 Dunn ..... F26B 25/18 211/41.6
6,170,676 B1 1/2001 Patadia et al.
6,357,605 B1 3/2002 Martorella
6,364,130 B2 * 4/2002 Wright ..... A47L 19/04 211/184
6,502,704 B2 1/2003 Martorella et al.
6,516,956 B2 * 2/2003 Martorella ..... A47L 19/04 211/41.5
6,581,774 B1 * 6/2003 Galafassi ..... A47G 21/14 206/379
D490,198 S 5/2004 Jerstroem et al.
6,737,150 B2 * 5/2004 Zahler ..... A47G 27/0231 428/156
6,763,954 B1 * 7/2004 Travers ..... A47L 19/02 211/41.3
D532,948 S * 11/2006 Gillisie ..... D32/55
7,344,036 B2 * 3/2008 Jerstroem ..... A47L 19/04 211/184
7,363,936 B1 * 4/2008 Simoneaux ..... B65D 25/06 137/312
7,407,059 B2 * 8/2008 Sullivan ..... A47L 19/04 211/41.3
7,458,470 B2 * 12/2008 Jerstroem ..... A47L 19/04 211/41.4
D634,909 S * 3/2011 Guthrie ..... D32/55
8,087,108 B2 * 1/2012 Burns ..... A47J 47/20 211/41.3
D692,199 S 10/2013 Huang
D693,082 S 11/2013 Evans et al.
8,573,410 B2 11/2013 Chalifoux
8,794,455 B2 * 8/2014 Yang ..... A47L 19/04 211/41.3
8,925,742 B1 * 1/2015 Chitayat ..... A47L 19/04 211/132.1
8,925,743 B1 * 1/2015 Lee ..... A47L 19/04 211/41.6
8,960,452 B2 * 2/2015 Rhodes, II ..... A47L 19/04 211/41.6
8,973,763 B2 * 3/2015 Pargansky ..... A47L 19/04 211/16
D732,256 S 6/2015 Huang
D736,488 S 8/2015 Le
9,107,552 B2 8/2015 Micek et al.
9,259,084 B1 * 2/2016 Palmer ..... A47B 46/00
D761,513 S * 7/2016 Traub ..... D32/56
9,427,135 B2 * 8/2016 Audet ..... A47L 19/04
2001/0040141 A1 * 11/2001 Martorella ..... A47L 19/04 211/41.6
2002/0084233 A1 * 7/2002 Martorella ..... A47L 19/04 211/41.6
2003/0232175 A1 * 12/2003 Zahler ..... A47G 27/0231 428/163
2004/0134866 A1 * 7/2004 Jerstroem ..... A47L 19/04 211/41.6
2005/0145583 A1 * 7/2005 Martorella ..... A47L 19/04 211/41.6
2007/0144984 A1 * 6/2007 Sullivan ..... A47L 19/04 211/41.3
2007/0151937 A1 * 7/2007 Gillisie ..... A47L 19/04 211/41.5
2008/0149644 A1 6/2008 Piacenza et al.
2008/0179264 A1 * 7/2008 Abrams ..... A47L 19/02 211/41.3
2008/0210648 A1 9/2008 Davis
2008/0263762 A1 * 10/2008 Burns ..... A47J 47/20 4/657
2008/0283480 A1 11/2008 Segall et al.
2010/0065517 A1 * 3/2010 Lam ..... A47L 19/04 211/41.3
2010/0143640 A1 * 6/2010 Wilmsen ..... A47G 27/0225 428/85
2010/0143645 A1 * 6/2010 Wilmsen ..... A47G 27/0206 428/116
2010/0297423 A1 * 11/2010 Chapman ..... B32B 3/10 428/304.4
2012/0208416 A1 * 8/2012 Lerman ..... B32B 5/028 442/1
2013/0105423 A1 5/2013 Chalifoux
2014/0332479 A1 * 11/2014 Audet ..... A47L 19/04 211/41.3

* cited by examiner

COMBINATION DISH DRYING MAT AND RACK

FIELD OF THE INVENTION

The invention broadly relates to a combination dish drying mat and rack for kitchenware and, more particularly, to an improved dish drying mat and rack for dishware, flatware, etc., that can be disassembled for more efficient cleaning and folded for compact storage.

BACKGROUND OF THE INVENTION

Dish drying mats and racks are well known articles of manufacture, which provide an area to dry and store various types of kitchenware, such as plates, bowls, glasses, utensils, etc. Generally, a dish drying rack includes a base and a plurality of drainage slots operatively arranged to hold and dry kitchenware. Similarly, a dish drying mat also provides an area to dry and store various types of kitchenware. However, drying mats typically include a cushioned planar surface instead of a base and plurality of drainage slots as seen in drying racks. Over the years, many devices have been developed to make the process of cleaning and drying dishes more efficient. Automatic, electric dishwasher appliances are well known, but expensive, and not affordable by everyone. Therefore, there is a continuing need for improved devices and methods for the manual washing and drying of dishes, flatware, cookware, and the like.

After being washed, dishes are usually placed in a drying rack on a countertop adjacent to a sink to expedite the air-drying process. A problem with prior dish drying racks is that some require the use of a towel underneath the rack to prevent water runoff from accumulating on the counter and subsequent spilling over onto the floor.

Another problem with prior dish drying racks is that some do not include an area for holding utensils. In these racks, the utensils tend to fall through the drainage slots onto the towel beneath the dish drying rack, and thus, never properly dry. While there are prior dish drying racks that do include a separate utensil area, they tend to be large and bulky, and therefore, difficult to clean and store.

A problem with prior dish drying mats is that most do not include any type of divisor, recess, or channel for holding plates vertically or for holding utensils. Therefore, it is difficult to dry and store a plurality of plates simultaneously on a drying mat as they plates occupy a large volume of space when stored horizontally on a drying mat.

Thus, there is a long-felt need for a combination dish drying mat and rack that includes a rack portion which rests upon a mat portion to allow water to runoff through apertures in the rack and be absorbed by the mat. There is also a long-felt need for an aesthetically pleasing combination dish drying rack and mat, from which water runoff can flow through the rack and be absorbed by the mat below. In addition, there is a long-felt need for a combination dish drying rack and mat that includes both a dishware area and a utensil area as well as the ability to be dismantled and folded for easy cleaning and compact storage.

BRIEF SUMMARY OF THE INVENTION

The present invention is a combination dish drying mat and rack generally including a mat and a rack. The mat has a top surface, bottom surface, and a plurality of sides. The rack has a base which rests upon at least a portion of the top surface of the mat in an open position. The rack has a plurality of ribs extending upwardly from the base and a corresponding plurality of channels formed by the plurality of ribs. The plurality of ribs and channels are operatively arranged to hold kitchenware in a substantially upright position. Preferably, the plurality of channels are co-planar and parallel to one another and the plurality of ribs are co-planar and parallel to one another and the plurality of ribs and channels extend laterally across the base of the rack. Additionally, the rack further includes a plurality of protrusions extending upwardly from the base and a plurality of slots recessed within the base. The plurality of protrusions are arranged in pairs and each protrusion of each pair is disposed opposite one another laterally across the base of the rack and the plurality of slots are co-planar and parallel to one another. Preferably, the plurality of ribs and the plurality of protrusions are integral with the base of the rack.

In one embodiment, the mat further includes at least one attachment means secured to the top surface of the mat and operatively arranged to secure the rack to the mat. Preferably, the at least one attachment means is at least one strap and the at least one strap is arranged to removably secure the base of the rack to the top surface of the mat. However, the at least one attachment means may be any suitable attachment means known in the art, such as a strap, hook and loop fastener, button, etc.

In another embodiment, the mat further includes a plurality of segments and at least one fold, wherein each fold is disposed as a divisor between each of two segments and the mat is operatively arranged to be foldable about the folds into a closed position. Preferably, the mat includes three segments and two folds and the rack rests upon the top surface of the second segment. The first segment is folded about the first fold and is disposed atop the rack and the third segment is folded about the second fold and is disposed atop the first fold. Additionally, the mat further includes at least one attachment means secured to the bottom surface of the mat to secure the mat in a closed position. Preferably, the at least one attachment means is a strap and the at least one strap removably secures the mat when folded into a closed position. However, the at least one attachment means may be any suitable attachment means known in the art, such as a strap, hook and loop fastener, button, etc.

In one embodiment, the rack is made of a substantially rigid material, such as plastic, metal, wood, etc. However, it should be appreciated that the rack can be made of any suitable material known in the art. Conversely, the mat is made of a substantially flexible material, such as microfiber, cloth, etc. However, it should be appreciated that the mat can be made of any suitable material known in the art.

In another embodiment, both the mat and rack are substantially rectangular in shape. However, it should be appreciated that both the mat and rack can be any suitable shape and of any suitable dimensions known in the art.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention in view of the accompanying drawing figures, in which.

DETAILED DESCRIPTION OF THE INVENTION

At the outset, it should be appreciated that like drawing numbers on different drawing views identify identical, or functionally similar, structural elements of the invention. It also should be appreciated that figure proportions and angles are not always to scale in order to clearly portray the attributes of the present invention.

While the present invention is described with respect to what is presently considered to be the preferred aspects, it is to be understood that the invention as claimed is not limited to the disclosed aspects. The present invention is intended to include various modifications and equivalent arrangements within the spirit and scope of the appended claims.

Furthermore, it is understood that this invention is not limited to the particular methodology, materials and modifications described and, as such, may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
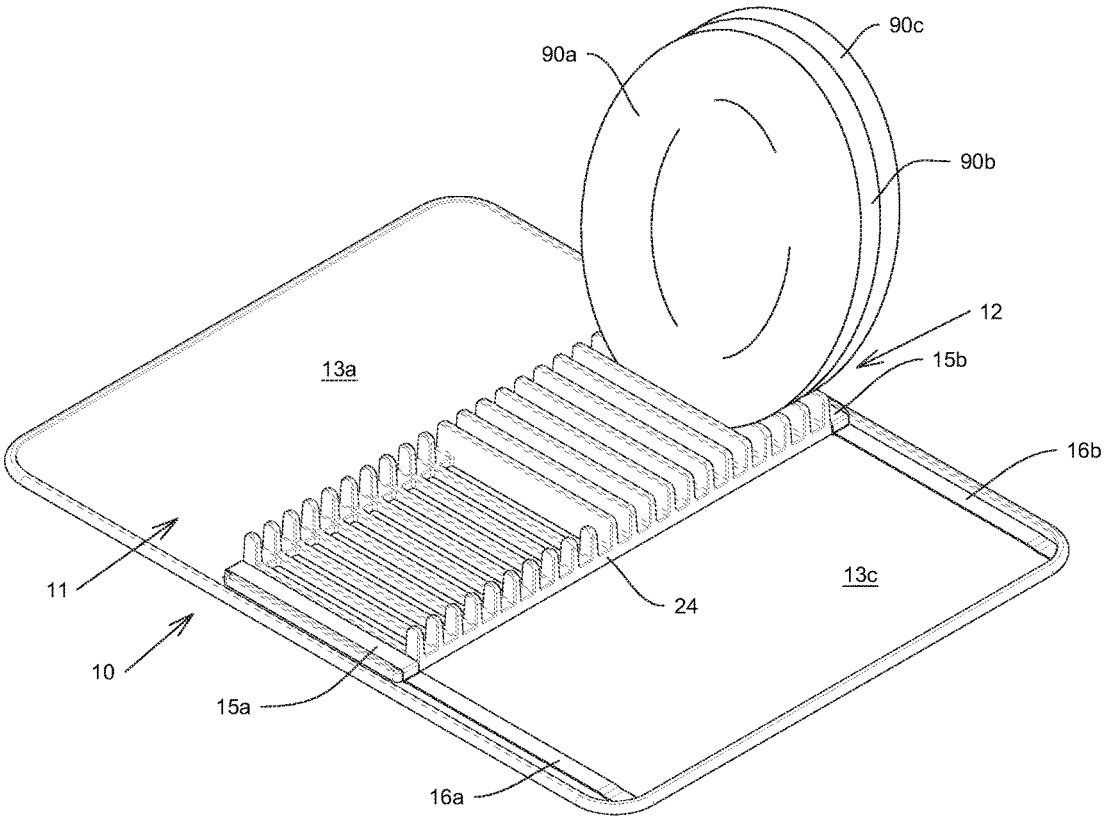
FIG. 1 is a perspective view of an embodiment of the present invention combination dish drying mat and rack, shown in a first open position and holding kitchenware items.

Adverting now to the figures, FIG. 1 is a perspective view of the present invention combination dish drying mat and rack 10, hereinafter referred to as "dish drying assembly 10." Dish drying assembly 10 includes mat 11 and rack 12. Mat 11 is adapted to rest upon a planar surface, such as a countertop and operatively arranged to hold and store kitchenware such as dishes, cups, utensils, etc. Similarly, rack 12 is operatively arranged to hold and store kitchenware, such as plurality of dishes 90*a*, 90*b*, and 90*c*, however, unlike mat 11, rack 12 holds the items in a substantially upright manner.

Figure 2:
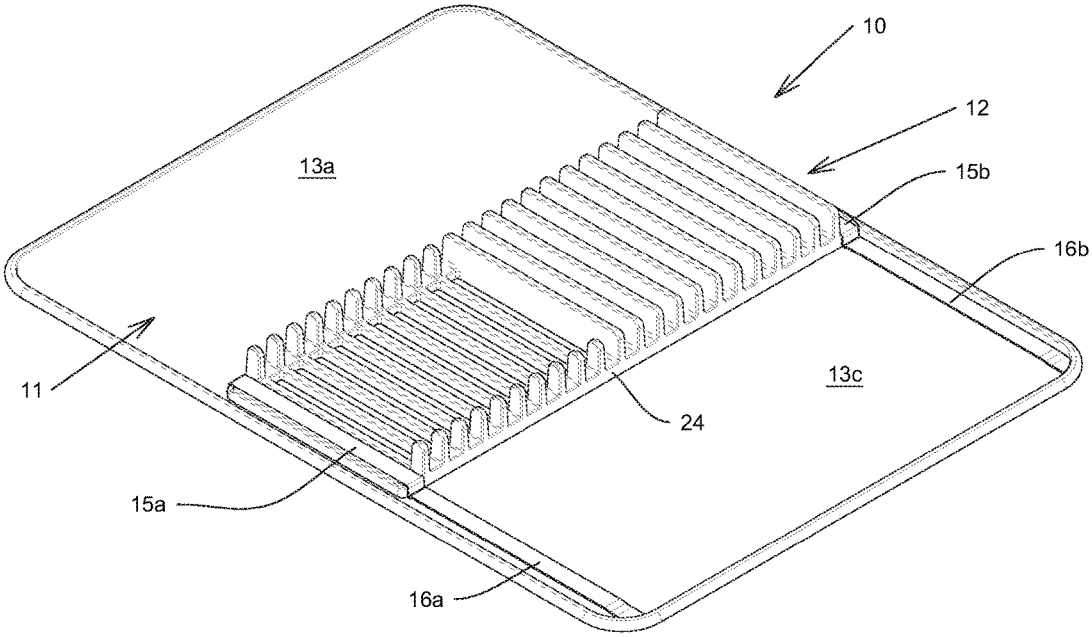
FIG. 2 is a front perspective view of the combination dish drying mat and rack similar to the view shown in FIG. 1, shown with the kitchenware removed.

FIG. 2 is a perspective view of dish drying assembly 10, similar to that of FIG. 1, but shown with plurality of dishes 90*a*, 90*b*, and 90*c* removed. Additionally, FIG. 2 shows dish drying assembly 10 in a first open position.

Figure 3:
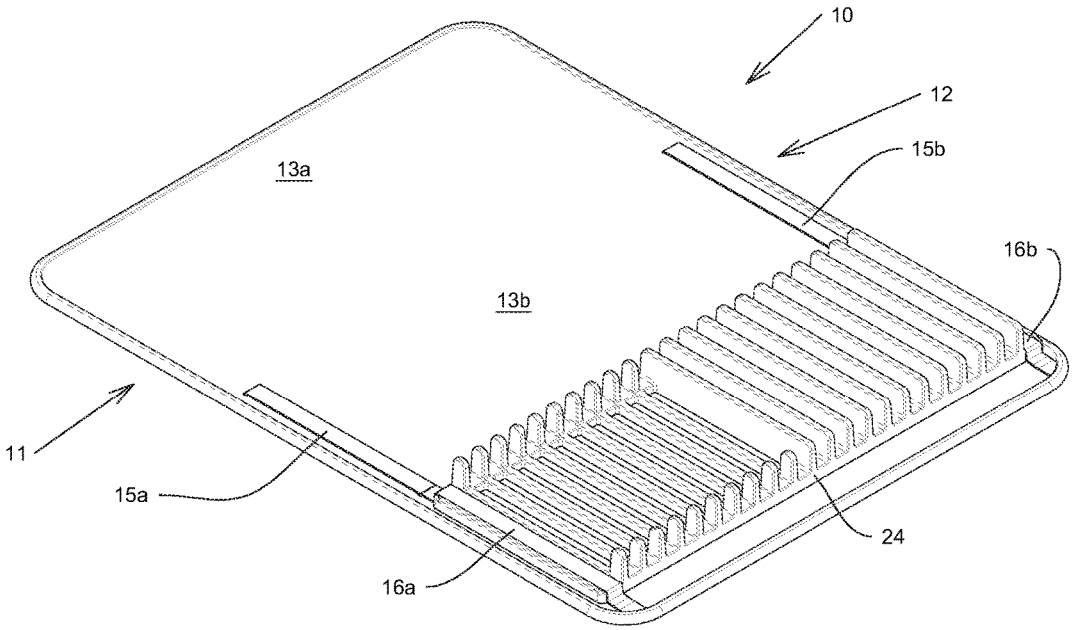
FIG. 3 is a perspective view of another embodiment of the combination dish drying mat and rack similar to the view shown in FIG. 2, but shown in a second open position.

Similar to FIG. 2, FIG. 3 is a perspective view of dish drying assembly 10. However, FIG. 3 shows dish drying assembly 10 in a second open position.

Figure 4:
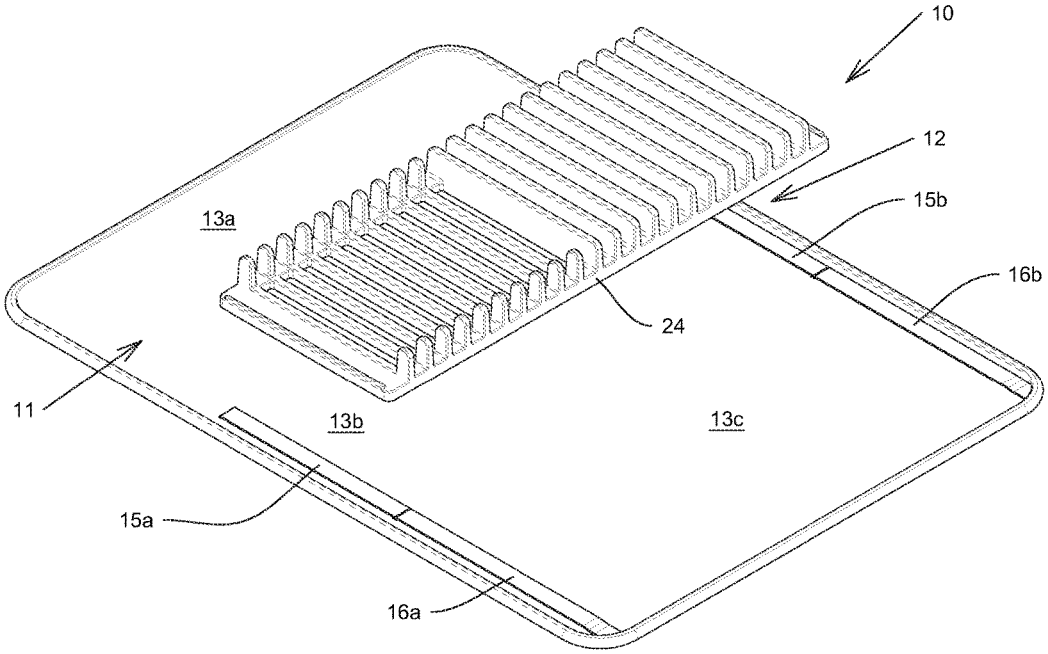
FIG. 4 is an exploded view of the combination dish drying mat and rack of FIG. 2.

FIG. 4 is an exploded view of dish drying assembly 10.

Figure 5:
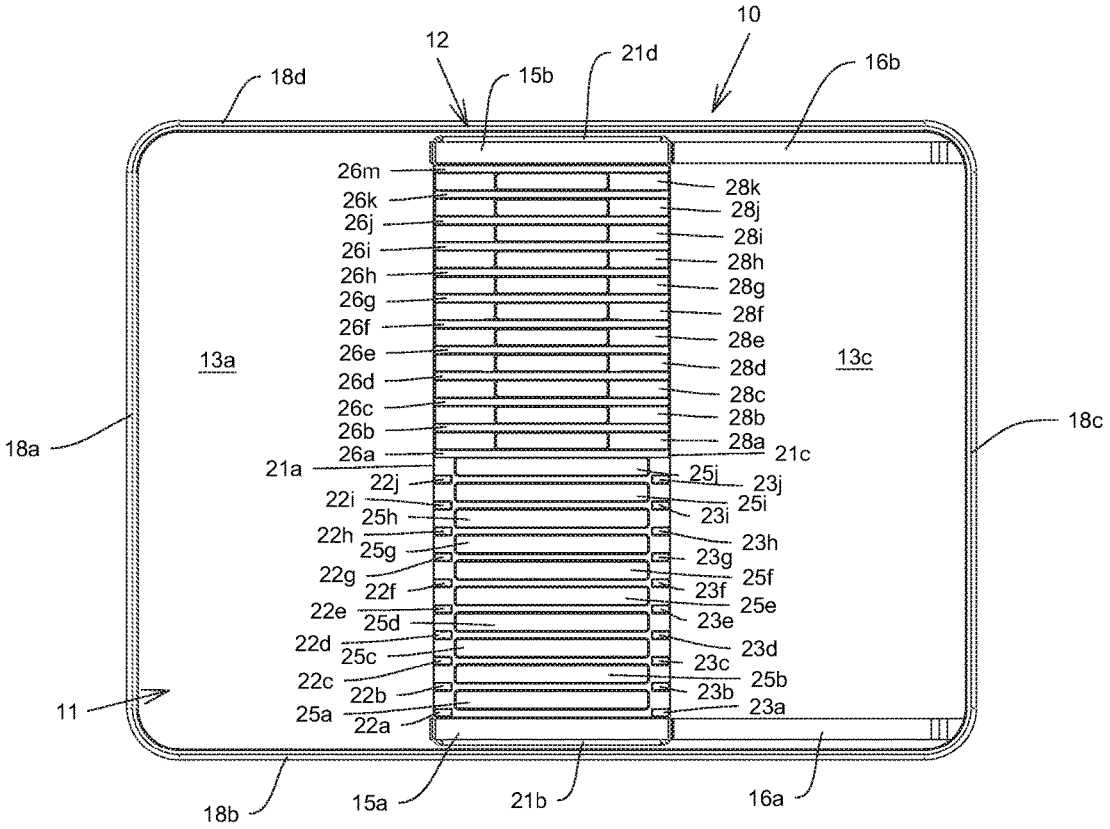
FIG. 5 is a top plan view of the combination dish drying mat and rack of FIG. 2.
Figure 6:
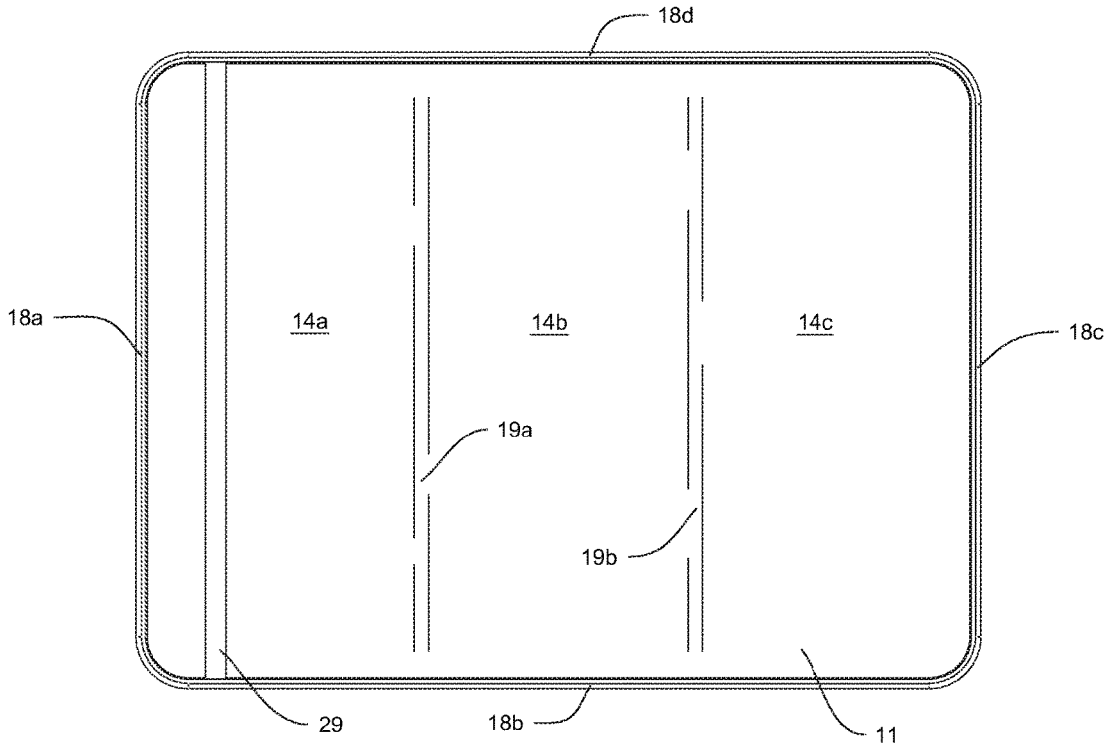
FIG. 6 is a bottom plan view of the combination dish drying mat and rack of FIG. 2.

FIG. 5 is a top plan view of dish drying assembly 10 and FIG. 6 is a bottom plan view of dish drying assembly 10.

Figure 7:
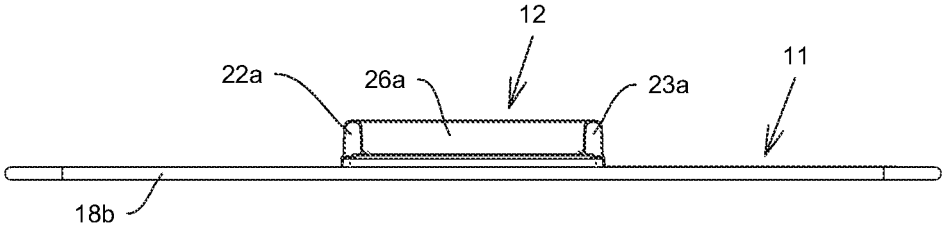
FIG. 7 is a front elevational view of the combination dish drying mat and rack of FIG. 2.
Figure 8:
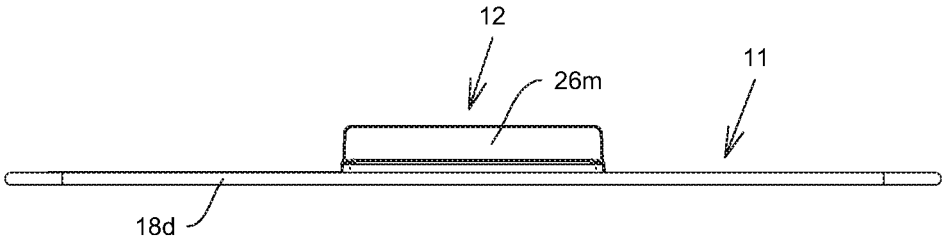
FIG. 8 is a rear elevational view of the combination dish drying mat and rack of FIG. 2.

FIG. 7 is a front elevational view of dish drying assembly 10 and FIG. 8 is a rear elevational view of the dish drying assembly 10.

Figure 9:
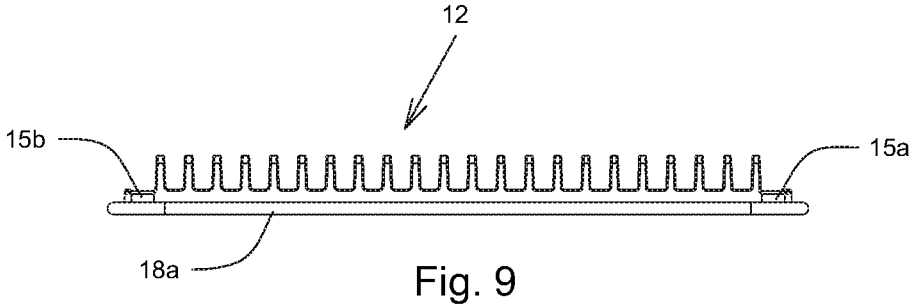
FIG. 9 is a left side elevational view of the combination dish drying mat and rack of FIG. 2.
Figure 10:
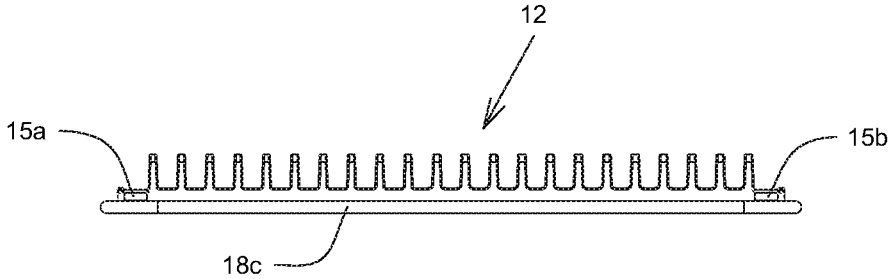
FIG. 10 is a right side elevational view of the combination dish drying mat and rack of FIG. 2; and, FIG. 11 is a perspective view of another embodiment of the combination dish drying mat and rack of FIG. 2, but shown in a closed position.

FIG. 9 is a left side elevational view of dish drying assembly 10 and FIG. 10 is a right side elevational view of dish drying assembly 10.

Figure 11:
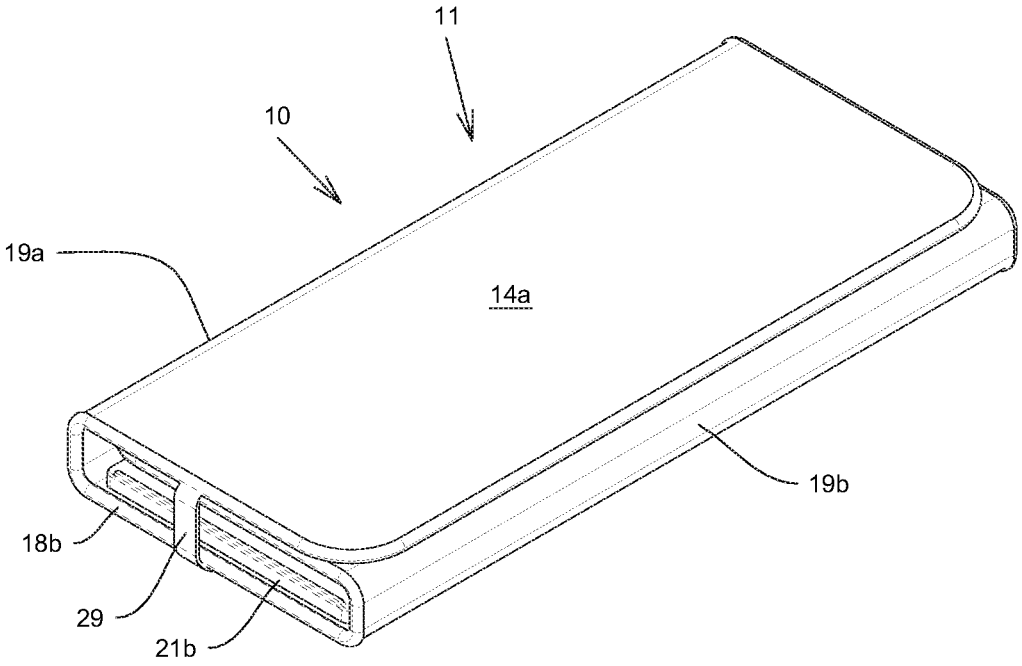

FIG. 11 is a perspective view of another embodiment of dish drying assembly 10, shown in a closed position.

As shown in FIGS. 1 through 11, dish drying assembly 10 generally includes mat 11 and rack 12. Mat 11 has top surface segments 13*a*, 13*b*, and 13*c*, bottom surface segments 14*a*, 14*b*, and 14*c*, and plurality of sides 18*a*, 18*b*, 18*c*, and 18*d*. Preferably, first side 18*a* and third side 18*c* are parallel to one another and second side 18*b* and fourth side 18*d* are parallel to one another. Additionally, second top surface segment 13*b* of mat 11 includes straps 15*a*, 15*b*. Similarly, third top surface segment 13*c* includes straps 16*a*, 16*b*. As shown in FIG. 2, rack 12 has base 24, which rests upon top surface segment 13*b* (shown in FIG. 4) of mat 11 forming a first open position. When in the first open position, strap 15*a* and strap 15*b* are disposed on opposite one another and removably secure base 24 of rack 12 to mat 11. Similarly, in FIG. 3, rack 12 has base 24; however, base 24 rests upon top surface segment 13*c* forming a second open position. When in the second open position, strap 16*a* and strap 16*b* are disposed opposite one another and removably secure base 24 of rack 12 to mat 11. This second open position provides a user with additional space for drying larger items, such as serveware, on mat 11. Although the figures show dish drying assembly in a first open position and a second open position, it should be readily apparent to those having ordinary skill in the art that other configurations are possible. Furthermore, it should be appreciate that while the rack is preferably secured to the mat via a plurality of straps, the attachment means for securing the rack to the mat may be any suitable attachment means known in the art, such as a strap, hook and loop fastener, button, etc.

As shown in FIG. 5, rack 21 includes rack edges 21*a*, 21*b*, 21*c*, and 21*d*. Preferably, first rack edge 21*a* and third rack edge 21*c* are parallel to one another and second rack edge 21*b* and fourth rack edge 21*d* are parallel to one another. Rack 12 has plurality of ribs 26*a*, 26*b* . . . 26*m* extending upwardly from base 24 and corresponding plurality of channels 28*a*, 28*b* . . . 28*k* formed by plurality of ribs 26*a*, 26*b* . . . 26*m*. Plurality of ribs 26*a*, 26*b* . . . 26*m* and plurality of channels 28*a*, 28*b* . . . 28*m* are operatively arranged to hold kitchenware in a substantially upright position. Preferably, plurality of channels 28*a*, 28*b* . . . 28*k* are co-planar and parallel to one another and plurality of ribs 26*a*, 26*b* . . . 26*m* are co-planar and parallel to one another and plurality of ribs 26*a*, 26*b* . . . 26*m* and plurality of channels 28*a*, 28*b* . . . 28*k* run laterally across base 24 of rack 12 from first rack edge 21*a* to third rack edge 21*c*. To facilitate drainage of water runoff, plurality of channels 28*a*, 28*b*, 28*c*, 28*d*, 28*e*, 28*f*, 28*g*, 28*h*, 28*i*, 28*j*, and 28*k* are integral with base 24 of rack 12. Preferably, plurality of ribs 26*a*, 26*b* . . . 26*m* are parallel to one another, are of substantially the same width and length, and are equally spaced with respect to one another. Similarly, plurality of channels 28*a*, 28*b* . . . 28*k* are parallel to one another, are of substantially the same width and length, and are equally space with respect to one another.

In particular, channel 28*a* is formed by base 24 and two adjacent ribs 26*a*, 26*b*; channel 28*b* is formed by base 24 and two adjacent ribs 26*b*, 26*c*; channel 28*c* is formed by base 24 and two adjacent ribs 26*c*, 26*d*; channel 28*d* is formed by base 24 and two adjacent ribs 26*d*, 26*e*; channel 28*e* is formed by base 24 and two adjacent ribs 26*e*, 26*f*; channel 28*f* is formed by base 24 and two adjacent ribs 26*f*, 26*g*; channel 28*g* is formed by base 24 and two adjacent ribs 26*g*, 26*h*; channel 28*h* is formed by base 24 and two adjacent ribs 26*h*, 26*i*; channel 28*i* is formed by base 24 and two adjacent ribs 26*i*, 26*j*; channel 28*j* is formed by base 24 and two adjacent ribs 26*j*, 26*k*; and channel 28*k* is formed by base 24 and two adjacent ribs 26*k*, 26*m*. Preferably, the height of each rib 26*a*, 26*b* . . . 26*m* is substantially equal, although it is should be apparent that ribs 26*a*, 26*b* . . . 26*m* of dish drying assembly 10 may vary in height. Although dish drying assembly 10 includes twelve (12) ribs and eleven (11) channels in a preferred embodiment, it is should be apparent that dish drying assembly 10 may include a fewer or greater number of ribs and channels.

Moreover, rack 12 further includes first plurality of protrusions 22*a*, 22*b* . . . 22*j*, second plurality of protrusions 23*a*, 23*b* . . . 23*j*, and plurality of slots 25*a*, 25*b* . . . 25*j* recessed within base 24. Preferably, first plurality of protrusions 22*a*, 22*b* . . . 22*j* are of uniform height, identical to one another, and extend upwardly from base 24. Similarly, second plurality of protrusions 23*a*, 23*b* . . . 23*j* arc of uniform height, identical to one another, and extend upwardly from base 24. First plurality of protrusions 22*a*, 22*b* . . . 22*j* and second plurality of protrusions 23*a*, 23*b* . . . 23*j* are arranged in complementary pairs, where each protrusion of each pair is disposed opposite one another laterally across base 24 of rack 12 from first rack edge 21*a* to third rack edge 21*c*. Plurality of slots 25*a*, 25*b* . . . 25*j* are co-planar and parallel to one another and run laterally across base 24 of rack 12 from first rack edge 21*a* to third rack edge 21*c*. Preferably, first plurality of protrusions 22*a*, 22*b* . . . 22*j*, and second plurality of protrusions 23*a*, 23*b* . . . 23*j* are integral with base 24 of rack 12. To facilitate drainage of water runoff, plurality of slots 25*a*, 25*b*, 25*c*, 25*d*, 25*e*, 25*f*, 25*g*, 25*h*, 25*i*, and 25*j* are integral with base 24 of rack 12.

Preferably, each slot is bounded by two complementary pairs of protrusions. In particular, slot 25*a* is bounded by pair of protrusions 22*a*, 23*a* and pair of protrusions 22*b*, 23*b*; slot 25*b* is bounded by pair of protrusions 22*b*, 23*b* and pair of protrusions 22*c*, 23*c*; slot 25*c* is bounded by pair of protrusions 22*c*, 23*c* and pair of protrusions 22*d*, 23*d*; slot 25*d* is bounded by pair of protrusions 22*d*, 23*d* and pair of protrusions 22*e*, 23*e*; slot 25*e* is bounded by pair of protrusions 22*e*, 23*e* and pair of protrusions 22*f*, 23*f*; slot 25*f* is bounded by pair of protrusions 22*f*, 23*f* and pair of protrusions 22*g*, 23*g*; slot 25*g* is bounded by pair of protrusions 22*g*, 23*g* and pair of protrusions 22*h*, 23*h*; slot 25*h* is bounded by pair of protrusions 22*h*, 23*h* and pair of protrusions 22*i*, 23*i*; and slot 25*i* is bounded by pair of protrusions 22*i*, 23*i* and pair of protrusions 22*j*, 23*j*. Slot 25*j* is the exception as it is bounded by pair of protrusions 22*j*, 23*j*, and rib 26*a*. Preferably, plurality of slots 25*a*, 25*b* . . . 25*j* are parallel to one another, are of substantially the same width and length, and are equally spaced with respect to one another. Although dish drying assembly 10 includes ten (10) complementary pairs of protrusions and ten (10) slots in a preferred embodiment, it is should be apparent that dish drying assembly 10 may include a fewer or greater number of pairs of protrusions and slots.

As shown in FIG. 6, mat 11 further includes folds 19*a*, 19*b*. Each fold 19*a*, 19*b* extends laterally across mat 11 from second mat side 18*b* to fourth mat side 18*d* and acts as a divisor between each of two segments. In particular, first fold 19*a* divides first bottom surface segment 14*a* and second bottom surface segment 14*b* as well as the corresponding first top surface segment 13*a* and second top surface segment 13*b*. Similarly, second fold 19*b* divides second bottom surface segment 14*b* and third bottom surface segment 14*c* as well as the corresponding second top surface segment 13*b* and third top surface segment 13*c*. Mat 11 is operatively arranged to be foldable about folds 19*a*, 19*b* into a closed position. As shown in FIG. 11, third top surface segment 13*c* is folded about second fold 19*b* and contacts rack 12. First top surface segment 13*a* is folded about first fold 19*a* and contacts third bottom surface segment 14*c*. Preferably, mat 11 further includes bottom strap 29 secured to first bottom surface segment 14*a* which is lifted and pulled approximately 180 degrees by a user around mat 11 to contact second bottom surface 14*b* and secure mat 11 in the closed position. It should be appreciated that while dish drying assembly 10 is preferably secured in a closed position via a strap, the attachment means for securing the dish drying assembly in a closed position may be any suitable attachment means known in the art, such as a strap, hook and loop fastener, button, etc.

Dish drying assembly 10 is disassembled in the first open position by lifting straps 15*a*, 15*b* up and lifting and/or sliding rack edges 21*b*, 21*d* from underneath straps 15*a*, 15*b*, respectively. Similarly, dish drying assembly 10 is disassembled in the second open position by lifting straps 16*a*, 16*b* up and lifting and/or sliding rack edges 21*b*, 21*d* from underneath straps 16*a*, 16*b*, respectively. Once disassembled, rack 12 and mat 11 can be cleaned efficiently and stored compactly. However, it should be appreciated that dish drying assembly 10 need not be disassembled to be stored, and as mentioned previously, dish drying assembly 10 may be stored in the aforementioned closed position.

Preferably, rack 12 is made of a substantially rigid and water resistant material, such as plastic, so that it can endure rigorous use without the possibility of warping due to water damage. However, it should be appreciated that the rack can be made of any suitable material known in the art, such as metal wood, etc. Conversely, mat 11 is made of a substantially flexible and absorbent material, such as microfiber, cloth, etc. However, it should be appreciated that the mat can be made of any suitable material known in the art as well.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed is:

1. A combination dish drying mat and rack, comprising:

a mat having a top surface, bottom surface, a plurality of sides, a plurality of segments and at least two folds, wherein each fold is disposed as a divisor between each of two segments and the mat is operatively arranged to be foldable about the folds into a closed position; and, a rack having a base, wherein the base of the rack rests upon at least a portion of the top surface of the mat in an open position, the rack having a plurality of ribs extending upwardly from the base and a plurality of channels, wherein the plurality of ribs form the corresponding plurality of channels, the plurality of ribs and channels are operatively arranged to hold kitchenware in a substantially upright position, and the rack is arranged to be disposed within at least a portion of the mat when the mat is folded into a closed position, the rack further comprising a plurality of protrusions extending upwardly from the base and a plurality of slots recessed within the base, wherein the plurality of protrusions are arranged in pairs and each protrusion of each pair is disposed opposite one another laterally across the base of the rack and the plurality of slots are co-planar and parallel to one another.

2. The combination dish drying mat and rack of claim 1, wherein the plurality of channels are co-planar and parallel to one another and the plurality of ribs are co-planar and parallel to one another and the plurality of ribs and channels extend laterally across the base of the rack.

3. The combination dish drying mat and rack of claim 1, wherein the plurality of ribs and the plurality of protrusions are integral with the base of the rack.

4. The combination dish drying mat and rack of claim 1, the mat further comprising at least one attachment means secured to the top surface of the mat and operatively arranged to secure the rack to the mat.

5. The combination dish drying mat and rack of claim 4, wherein the at least one attachment means is a strap and the at least one strap is arranged to removably secure the base of the rack to the top surface of the mat.

6. The combination dish drying mat and rack of claim 1, wherein the mat includes three segments and two folds and the rack rests upon the top surface of the second segment, wherein the first segment is folded about the first fold and is disposed atop the rack and the third segment is folded about the second fold and is disposed atop the first fold.

7. The combination dish drying mat and rack of claim 1, the mat further comprising at least one attachment means secured to the bottom surface of the mat to secure the mat in a closed position.

8. The combination dish drying mat and rack of claim 7, wherein the at least one attachment means is a strap and the at least one strap is arranged to removably secure the mat when folded into a closed position.

9. The combination dish drying mat and rack of claim 1, wherein the rack is made of a substantially rigid material.

10. The combination dish drying mat and rack of claim 9, wherein the rack is made of plastic.

11. The combination dish drying mat and rack of claim 1, wherein the mat is made of a substantially flexible material.

12. The combination dish drying mat and rack of claim 11, wherein the mat is made of microfiber.

13. The combination dish drying mat and rack of claim 1, wherein the mat is substantially rectangular in shape.

14. The combination dish drying mat and rack of claim 1, wherein the rack is substantially rectangular in shape.

15. A combination dish drying mat and rack, comprising:

a mat having a top surface, bottom surface, a plurality of sides, a plurality of segments and at least two folds, wherein each fold is disposed as a divisor between each of two segments and the mat is operatively arranged to be foldable about the folds into a closed position; and, a rack having a base, wherein the base of the rack rests upon at least a portion of the top surface of the mat in an open position, the rack having:

a plurality of ribs extending upwardly from the base;

a plurality of channels, wherein the plurality of ribs form the corresponding plurality of channels, and the plurality of ribs and channels are operatively arranged to hold kitchenware in a substantially upright position and the plurality of channels are co-planar and parallel to one another and the plurality of ribs are co-planar and parallel to one another;

a plurality of protrusions extending upwardly from the base, wherein the plurality of protrusions are arranged in pairs and each protrusion of each pair is disposed opposite one another laterally across the base of the rack; and, a plurality of slots recessed within the base, wherein the plurality of slots are co-planar and parallel to one another and the plurality of protrusions and slots are operatively arranged to hold kitchenware and the rack is arranged to be disposed within at least a portion of the mat when the mat is folded into a closed position.

16. The combination dish drying mat and rack of claim 15, the mat further comprising at least one attachment means secured to the top surface of the mat and operatively arranged to removably secure the base of the rack to the top surface of the mat.

17. The combination dish drying mat and rack of claim 15, wherein the includes three segments and two folds and the rack rests upon the top surface of the second segment, wherein the first segment is folded about the first fold and is disposed atop the rack and the third segment is folded about the second fold and is disposed atop the first fold.

* * * * *